United States Patent [19]

Kimura et al.

[11] Patent Number: 4,918,955

[45] Date of Patent: Apr. 24, 1990

[54] VEHICLE KEY DEVICE

[75] Inventors: Takashi Kimura; Mitsuo Mori, both of Aichi, Japan

[73] Assignee: Kabushiki Kaisha Tokai Rika Denki Seisakusho, Aichi, Japan

[21] Appl. No.: 105,039

[22] Filed: Oct. 6, 1987

[30] Foreign Application Priority Data

Oct. 7, 1986 [JP] Japan ..... 61-238489

[51] Int. Cl.[5] ..... E05B 47/00

[52] U.S. Cl. ..... 70/277; 70/413

[58] Field of Search ..... 70/275, 276, 277, 413, 70/395

[56] References Cited

U.S. PATENT DOCUMENTS

| | | | |
|---|---|---|---|
| 2,882,455 | 4/1959 | Ferguson | 70/277 X |
| 3,222,534 | 12/1965 | Scott | 70/277 X |
| 3,225,576 | 12/1965 | Richard | 70/277 |
| 3,283,550 | 11/1966 | Bradway | 70/277 |
| 3,336,770 | 8/1967 | Parsons | 70/277 X |
| 3,347,072 | 10/1967 | Rose | 70/277 |
| 3,660,831 | 5/1972 | Nicola et al. | 70/277 X |
| 4,229,959 | 10/1980 | Easley | 70/413 X |
| 4,232,353 | 11/1980 | Mosciatti et al. | 70/277 X |
| 4,280,163 | 7/1981 | Osborne | 70/277 X |
| 4,326,125 | 4/1982 | Flies | 70/277 X |
| 4,331,013 | 5/1982 | Jaulmes | 70/413 X |
| 4,392,134 | 7/1983 | Lutz | 70/413 X |
| 4,458,512 | 7/1984 | Gelhard | 70/277 |
| 4,507,944 | 4/1985 | Widen et al. | 70/413 X |
| 4,537,049 | 8/1985 | Lupoli | 70/277 |
| 4,562,711 | 1/1986 | Fliege | 70/413 X |
| 4,593,544 | 6/1986 | Claar et al. | 70/277 X |

FOREIGN PATENT DOCUMENTS

| | | | |
|---|---|---|---|
| 0086491 | 8/1983 | European Pat. Off. | 70/413 |

*Primary Examiner*—Gary L. Smith
*Assistant Examiner*—Suzanne L. Dino
*Attorney, Agent, or Firm*—Finnegan, Henderson, Farabow, Garrett and Dunner

[57] ABSTRACT

In a vehicle key device, when a key is inserted into a lock, the former is magnetically coupled to the latter so that data are transmitted therebetween, and only when the data provided by the lock and key correspond with each other is the driving of the engine permitted. This device positively prevents the driving of a vehicle by an unauthorized person.

10 Claims, 2 Drawing Sheets

VEHICLE KEY DEVICE

BACKGROUND OF THE INVENTION

1. Field of the Invention

This invention relates to key devices for vehicles and more particularly to a vehicle key device suitable for preventing a vehicle from being stolen.

A vehicle such as an automobile is sometimes stolen when the operator forgets to lock the vehicle. However, a vehicle may still be illicitly unlocked and stolen, even when it has been locked.

2. Description of the Prior Art

Means for preventing a vehicle lock from being released, thereby preventing the theft of a vehicle, have been proposed by Japanese Application Publication No. 2991/1966, Japanese Patent Application (OPI) No. 81239/1984 (the term "OPI" as used herein means "an unexamined published application"). Such a device is, however, disadvantageous in that the reliability in reading the data may be decreased in case of a contact fault of the bar code board, since the data printed on the board are read in a contact mode. To overcome this difficulty, the following device has been proposed by Japanese Patent Application (OPI) No. 72867/1985. In the device, light is applied to a bar code board on which predetermined data have been printed. Detection of an optical signal from the bar code board releases the lock of a vehicle door or steering wheel. With the device, the data can be read even in a non-contact mode. Therefore, the above-described difficulty with vehicle key devices that employ contact means can be eliminated. However, the above-described device in which the data printed on the bar code board are read as optical signals is still disadvantageous because it may fail to function when dust sticks on the bar code board or when the bar code board is inserted at high speed.

SUMMARY OF THE INVENTION

The present invention overcomes the problems and disadvantages of the prior art by employing a magnetically coupled lock and key.

An object of this invention is to provide a vehicle key device in which a lock is magnetically coupled to a key so as to transmit engine drive data between the lock and the key, so that only when the data of the lock and key coincide with each other is the driving of the engine permitted.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

To achieve the objects and in accordance with the purpose of the invention, as embodied and broadly described herein, the invention comprises a vehicle lock having a keyhole for inserting a key comprising a key, a wound coil disposed adjacent the keyhole for electrically engaging the key in response to the insertion of the key in the keyhole, signal generating means for applying a data detecting signal to the wound coil, circuit means mounted on the key disposed to magnetically couple with the wound coil for generating first predetermined data in the data detecting signal, the first predetermined data being distinctive to the key, signal detecting means for detecting the generated first predetermined data, means for storing second predetermined data, and control means responsive to the first predetermined data and the second predetermined data for selectively generating a permission signal.

In another respect the invention comprises an annular core disposed around the key inserting hole of a vehicle lock; a rotor coil wound on the annular core; signal generating means for supplying a data detecting signal to the rotor coil; signal detecting means operative to provide an output signal in response to detection of a signal transmitted through the rotor coil; means storing deciding data; control means for comparing data provided by the output signal of the signal detecting means with the deciding data, and applying an engine drive permission signal to an engine drive section at times when the data coincide with each other in content; and a key insertable into the key inserting hole of the lock, the key including a bar-shaped core, which, when the key is inserted into the key inserting hole, engages with the annular core at two points, to form a magnetic circuit; a key coil wound on the bar-shaped core, the key coil being magnetically coupled to the rotor coil when the key is inserted into the key inserting hole; and data generating means including the key coil for causing the key coil to provide a signal to the signal generating means including predetermined data in response to a signal induced in the key coil.

The accompanying drawings which are incorporated in and constitute a part of this specification illustrate several embodiments of the invention and together with the description, serve to explain the principles of the invention.

DETAILED DESCRIPTION OF THE PREFERRED EMBODIMENTS

Reference will now be made in detail to the present preferred embodiments of the invention, examples of which are illustrated in the accompanying drawings. Wherever possible, the same reference numbers will be used throughout the drawings to refer to the same or like parts.

A first embodiment of this invention will be described with reference to FIGS. 1 through 4.

Figure 1:
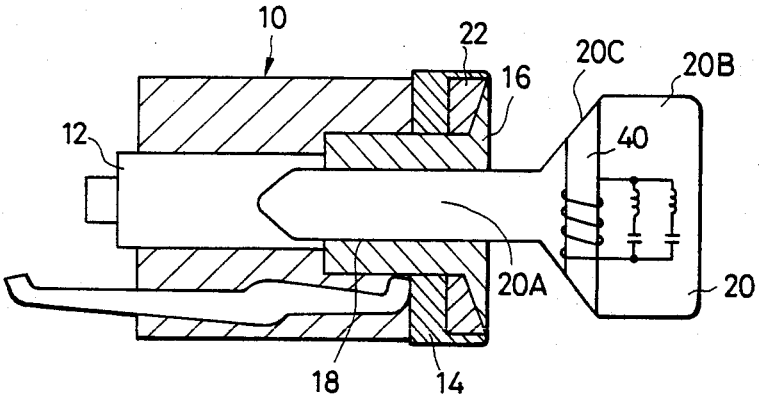
FIG. 1 is an explanatory diagram showing the arrangement of one embodiment of this invention.
Figure 2:
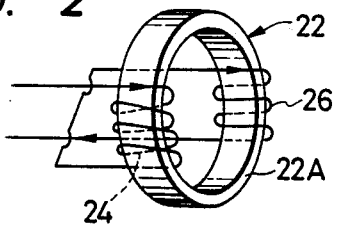
FIG. 2 is a perspective view of the annular core in the embodiment of FIG. 1.
Figure 3:
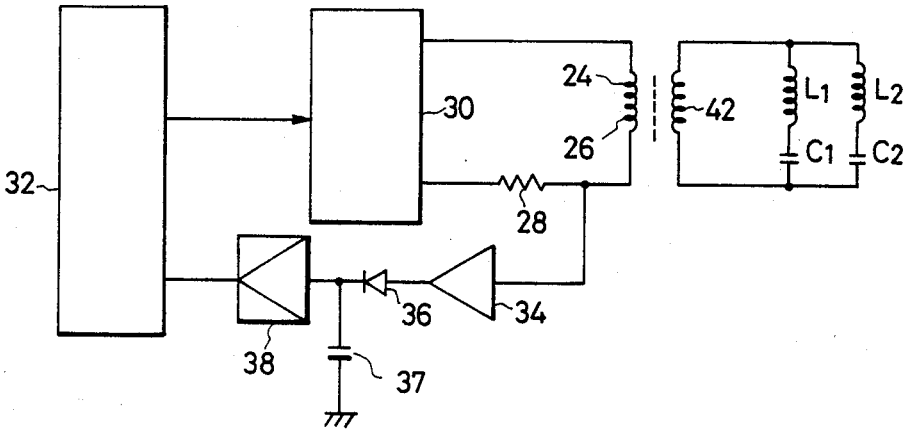
FIG. 3 is a circuit diagram with block diagram elements showing the embodiment of FIG. 1.

As shown in FIG. 1, a lock 10 has a key inserting hole 12. An annular rotor case 14 is secured to the key-inserting-hole's inlet side of the lock 10. A cylindrical rotor 16 is rotatably mounted inside the rotor case 14. A key inserting hole 18 is formed in the rotor 16 in such a manner that it communicates with the key inserting hole 12, and can receive the end portion 20A of a flat, plate-shaped key 20. An annular core 22 is fitted on the rotor 16. As shown in FIG. 2, one end portion 22A of the core 22 is tapered and exposed at the inlet end of the key inserting hole 18. Rotor coils 24 and 26 are wound on the core 22 in one and the same direction. More specifically, the rotor coils 24 and 26 are symmetrically wound on the core 22 so that the magnetic flux formed by the rotor coil 24 and that formed by the rotor coil 26 cancel each other out. As shown in FIG. 3, the rotor coils 24 and 26 are connected through a resistor 28 to a variable frequency oscillator 30.

In response to a microcomputer 32, the oscillator 30 applies a data detecting signal to the rotor coils 24 and 26. That is, the frequency variable oscillator 30 operates as signal generating means. The rotor coils 24 and 26 are connected through an amplifier 34, a diode 26, a capacitor 37 and an A/D (analog to digital) converter 38 to the microcomputer 32. A current (data) flowing in the rotor coils 24 and 26 is detected as a voltage drop across the resistor 28, and the detection output is supplied through the amplifier 34, the diode 36, and the A/D converter 38 to the microcomputer 32. That is, the resistor 28, the amplifier 34, the diode 36, and the A/D converter 38 form signal detecting means for detecting a signal transmitted through the rotor coils 24 and 26.

The microcomputer 32, serving as control means, controls an engine drive section according to data provided by the A/D converter 38. More specifically, in the microcomputer 32, data provided as signals by the A/D converter 38 are compared with deciding data stored in a ROM, and only when both data coincide with each other is an engine drive permission signal supplied to the engine drive section.

The key 20 has a grip 20B. The front end portion 20C of the key grip 20B is tapered so that it is engageable with the tapered surface of the annular core 22. A bar-shaped core 40 is provided substantially at the middle of the front end of portion 20C of the key grip 20B in such a manner that, when the key 20 is inserted into the key inserting hole 18, the core 40 is connected to the annular core 22 at two points to form one magnetic circuit. A key coil 42 is wound on the core 40 in such a manner that, when the key 20 is inserted into the key inserting hole 18, the key 20 is magnetically coupled to a resonant circuit consisting of a coil L1 and a capacitor C1, and to another resonant circuit consisting of a coil L2 and a capacitor C2. The coils L1 and L2 and the capacitors C1 and C2 are selected so that the resonant circuits have different resonant frequencies.

Figure 4:
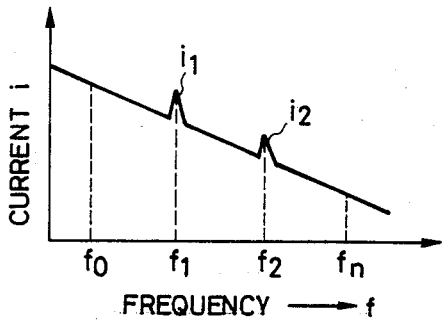
FIG. 4 is a graphical representation indicating current function of frequency for the rotor coils shown in the embodiment of FIG. 3.

When the data detecting signal supplied to the rotor coils 24 and 26 from the frequency variable oscillator 30 changes in frequency as shown in FIG. 4, current flows in the rotor coils 24 and 26 in correspondence to the frequency change. In FIG. 4, reference character $i_1$ designates the resonant current of the coil L1 and the capacitor C1, and $i_2$ the resonant current of the coil L2 and the capacitor C2. Thus, the coils L1 and L2 and the capacitors C1 and C2 form data generating means which, in response to a signal induced in the key coil 42, causes the key coil 42 to generate a signal containing predetermined data.

When the current shown in FIG. 4 is supplied through the amplifier 34, the diode 36, and the A/D converter 38 to the microcomputer 32, the data is compared with the deciding data in the microcomputer 32. Note that the current values $i_2$ and $i_2$ at the frequencies $f_1$ and $f_2$ are stored as the deciding data in the ROM connected to microcomputer 32 in advance. Then, the signal provided by the output signal of the frequency variable oscillator 30 is read, and only when the signal thus read coincides with the deciding data is the engine drive permission signal output. Thus, the engine can be driven only when the key 20 is inserted into the key inserting hole 18. Since the engine can be driven only when the special key 20 is inserted into the key insertion hole 18, theft of the vehicle can be prevented.

Furthermore, in this preferred embodiment, the engine can be driven only when the engine drive data is transmitted through the magnetic coupling of the lock 10 and the key 20.

Figure 5:
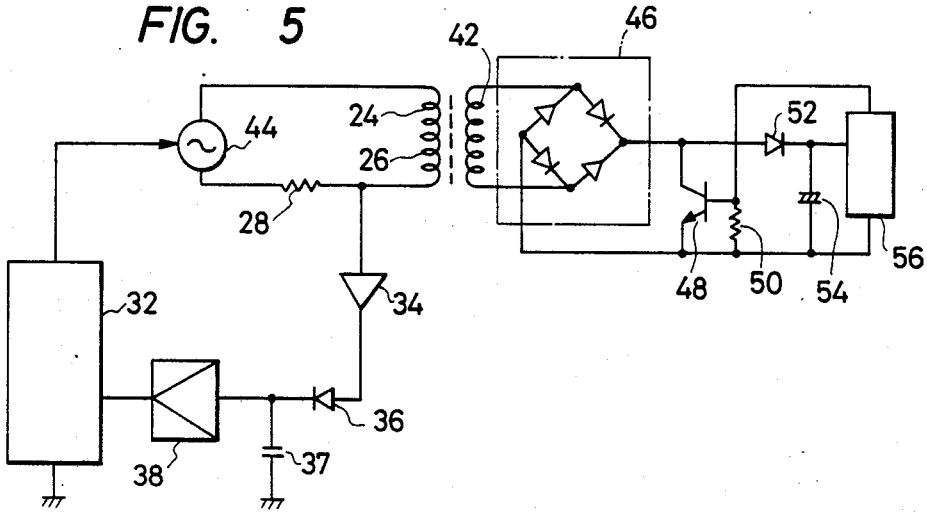
FIG. 5 is a circuit diagram with block diagram el showing the arrangement of another embodiment of the invention.

FIG. 5 shows a second embodiment of the invention. The second embodiment of FIG. 5 corresponds to the first embodiment of FIG. 3. Therefore, in FIG. 5, those circuit elements which have been described with reference to FIG. 3 are designated by the same reference numerals or characters. As is apparent from comparison between FIGS. 3 and 5, in the second embodiment, a constant frequency oscillator 44 is employed instead of the variable frequency oscillator 30. Additionally, a full-wave rectifier circuit 46 is connected to both ends of the key coil, and a transistor 48, a resistor 50, a diode 52, a capacitor 54 and a code generating circuit 56 are provided on the output side of the full-wave rectifier circuit 46.

Figure 6:
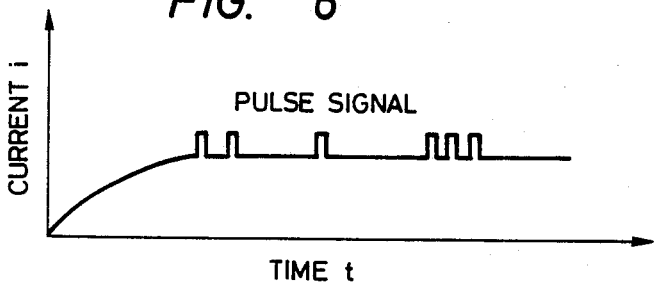
FIG. 6 is a graph of current as a function of time showing a code signal employed in the embodiment of FIG. 5.

The code generating circuit 56 is adapted to generate a code signal in correspondence to deciding data stored in the microcomputer 32. When the signal induced in the key coil 42 is rectified by the full-wave rectifier circuit 46 and supplied through the diode 52 to the code generating circuit 56, the code generating circuit 56 applies a predetermined code signal, i.e., a pulse signal as shown in FIG. 6, to the base of the transistor 48, so that the transistor 48 is turned on and off by the code signal. When the transistor 48 is rendered conductive (on), the key coil 42 is short-circuited, so that the current flow in the rotor coil changes. The current value changes with the code signal output by the code generating circuit 56. This current change is applied through the amplifier 34, the diode 36, and the A/D converter 38 to the microcomputer 32. The microcomputer 32 compares the data provided by the A/D converter 38 with the deciding data, and, when both data coincide with each other, applies the engine drive permission signal to the engine drive section, thus permitting the driving of the engine.

In the second embodiment shown in FIG. 5, the full-wave rectifier circuit 46, the transistor 48, the resistor 50, the diode 52, the capacitor 54, and the code generating circuit 56 form data generating means. In response to the signal induced in the key coil 42, the code generating circuit 56 outputs the code signal. According to the code signal thus output, the variation of the current in the rotor coils 24 and 26 is read to permit the driving of the engine. Thus, in the second embodiment, tee driving of the engine is permitted only when the data provided by the output code signal of the code generating circuit coincides with the deciding data. Thus, the vehicle cannot be stolen and the lock cannot be released by a person not possessing the key.

As described above, according to the invention, the annular core on the lock side is magnetically coupled to the bar-shaped core on the key side so that the engine driving data are transmitted between the lock and the key. The engine can be driven only when the data from the key side coincides with the data from the lock side.

Therefore, the invention eliminates the difficulties resulting from dust stuck on the key or the too-quick insertion of the key.

What is claimed is:

1. A vehicle lock having a keyhole for inserting a key comprising:

a key;

a wound coil surrounding the keyhole for magnetically coupling the key in response to the inserting of the key in the keyhole;

signal generating means for applying a data detecting signal to the wound coil;

circuit means mounted on the key disposed to magnetically couple the wound coil for generating first predetermined data in the data detecting signal, said first predetermined data being distinctive to the key;

signal detecting means for detecting the generated first predetermined data;

means for storing second predetermined data; and control means responsive to the first predetermined data and the second predetermined data for selectively generating a permission signal.

2. The vehicle lock of claim 1, wherein the key-mounted circuit means includes inductor means and means connected to said inductor means producing a variable current flow in the data detecting signal when the key is inserted into the keyhole.

3. The vehicle lock of claim 2, wherein the means for producing the variable current flow comprises a plurality of resonant circuit means each having a different resonant frequency.

4. The vehicle lock of claim 3, wherein the plurality of resonant circuit means each comprises a second inductor means and a capacitor connected in series therewith.

5. The vehicle lock of claim 2, wherein the means for producing the variable current flow in the data detecting signal comprises rectifying means for rectifying said detecting signal and code generating circuit means including means responsive to said rectified detecting signal for generating a predetermined code of current pulses.

6. The vehicle lock of claim 1, wherein the signal generating means comprises a variable frequency oscillator responsive to said control means for generating the data detecting signal.

7. The vehicle lock of claim 1, wherein the signal generating means comprises a constant frequency oscillator responsive to said control means for generating the data detecting signal.

8. The vehicle lock of claim 1, wherein the signal detecting means comprises an analog to digital convertor means connected to the wound coil, said converter means for converting the first predetermined data to digital form.

9. The vehicle lock of claim 1 wherein the control means comprises a comparison means for comparing the first predetermined data and the second predetermined data.

10. A vehicle key device comprising:

an annular core disposed around the key inserting hole of a vehicle lock;

a rotor coil wound on said annular core;

signal generating means for supplying a data detecting signal to said rotor coil;

signal detecting means operative to provide an output signal in response to detection of a signal transmitted through said rotor coil;

means storing deciding data;

control means for comparing data provided by the output signal of said signal detecting means with the deciding data, and applying an engine drive permission signal to an engine drive section at times when said data coincide with each other in content; and a key insertable into said key inserting hole of said lock, said key including:

a bar-shaped core which, when said key is inserted into said key inserting hole, engages with said annular core at two points, to form a magnetic circuit;

a key coil wound on said bar-shaped core, said key coil being magnetically coupled to said rotor coil when said key is inserted into said key inserting hole; and data generating means including the key coil for causing said key coil to provide a signal to said signal generating means including predetermined data in response to a signal induced in said key coil.

* * * * *